United States Patent [19]

Lohr et al.

[11] 4,006,899

[45] Feb. 8, 1977

[54] DEVICE SIMULATING PLAY ACTION GAME

[75] Inventors: Raymond J. Lohr; Richard N. Carver; Charles M. Kienholz; Calvin S. Cook; Maxmillian P. Rogers, all of Erie, Pa.

[73] Assignee: Louis Marx & Co., Inc., Glen Dale, W. Va.

[22] Filed: Mar. 3, 1976

[21] Appl. No.: 663,375

Related U.S. Application Data

[63] Continuation-in-part of Ser. No. 544,545, Jan. 27, 1975, abandoned.

[52] U.S. Cl. ..... 273/85 R; 273/1 E

[51] Int. Cl.[2] ..... A63F 9/14

[58] Field of Search ..... 273/1 E, 85 R, 101.1, 273/101.2, 101, 105.1, DIG. 28, 126 R

[56] References Cited

UNITED STATES PATENTS

| | | | |
|---|---|---|---|
| 2,644,884 | 7/1953 | Sullivan | 273/105.1 |
| 2,665,133 | 1/1954 | Garrido | 273/105.1 |
| 3,326,552 | 6/1967 | Bilbao | 273/1 E |
| 3,583,538 | 6/1971 | Hurley | 273/85 R |
| 3,778,058 | 12/1973 | Rausch | 273/85 R |
| 3,857,564 | 12/1974 | Goldfarb et al. | 273/126 R |

*Primary Examiner*—Richard C. Pinkham
*Assistant Examiner*—Harry G. Strappello
*Attorney, Agent, or Firm*—Blum, Moscovitz, Friedman & Kaplan

[57] ABSTRACT

A game device is provided which has a high degree of sustained recreational and entertainment value. The game includes a housing fitted with a removable screen. The screen includes indicia which simulate a field of play, for instance a tennis court, hockey field, soccer field or the like. Screens with different fields of play may be interchangeably mounted on the housing. A boom is mounted in the housing for universal movement in a plan substantially parallel to the screen. A signal means is mounted in the universally movable end of the boom for projecting a signal on the screen simulating a play action game piece, for instance, a tennis ball or hockey puck in play on the simulated field. The signal end of the boom is reciprocable with the housing across the screen. Deflectors are movably mounted in the housing for buffeting the signal end of the boom across the screen at random verticals to the reciprocal horizontal. Each deflector is movable along a corresponding end line or goal of the field of play provided on the screen for thereby keeping the game piece in play in a manner corresponding, for instance, to tennis match play or to a hockey match, as observed on the screen. Each cross field buffet of the signal end of the boom by a respective deflector corresponds to a successful return of the game piece and each concomitant misregistration of a deflector and the signal end of the boom corresponds to a missed game piece which may, for instance, conclude a match play point or signify that a goal has been made.

18 Claims, 11 Drawing Figures

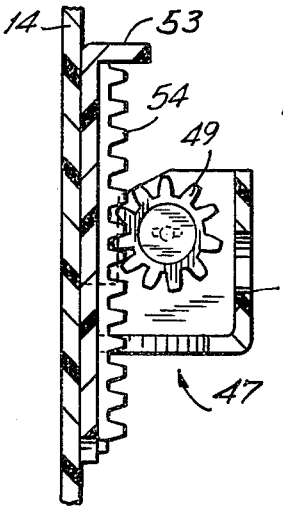
FIG. 5
FIG. 6
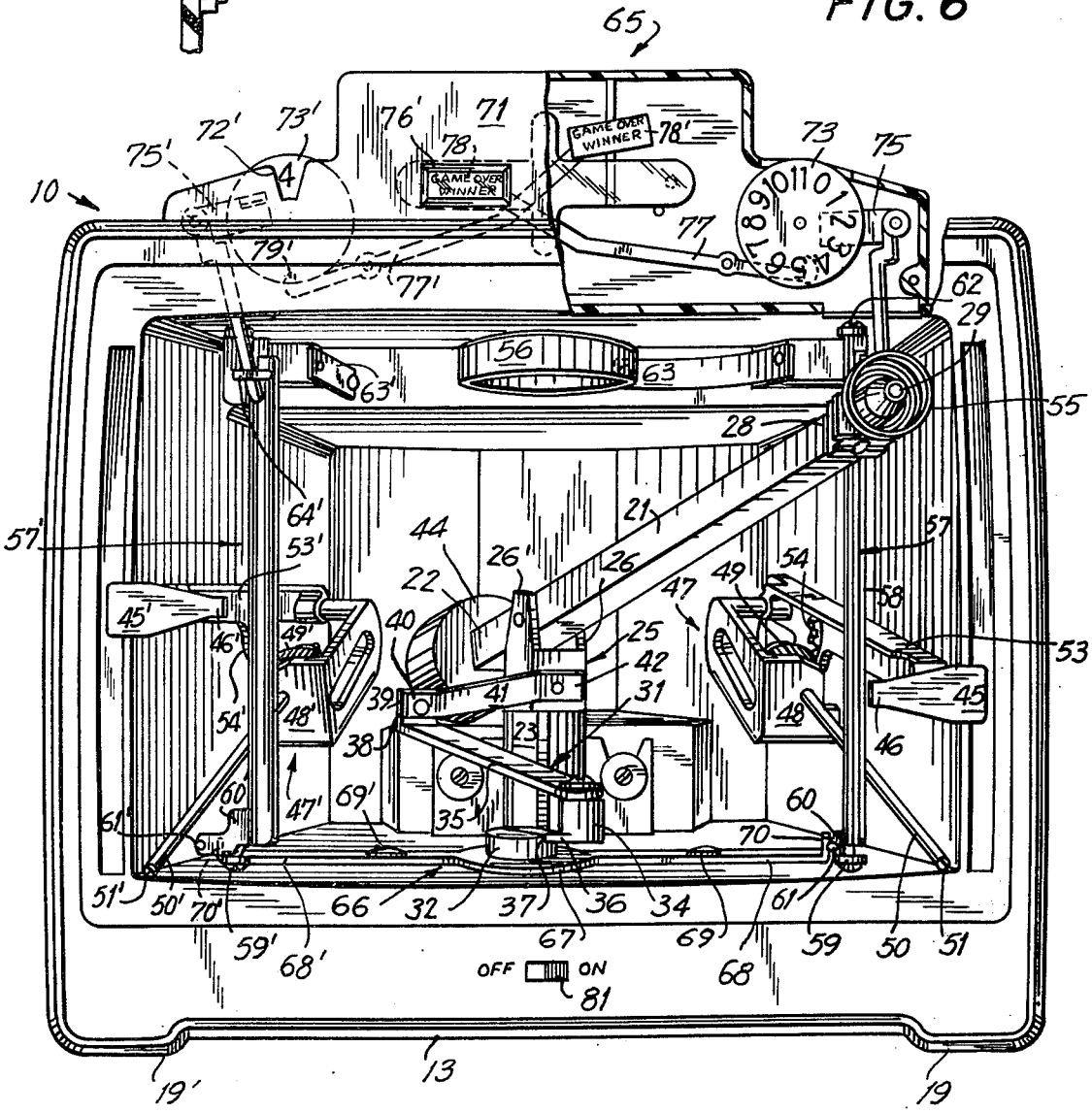

FIG. 7
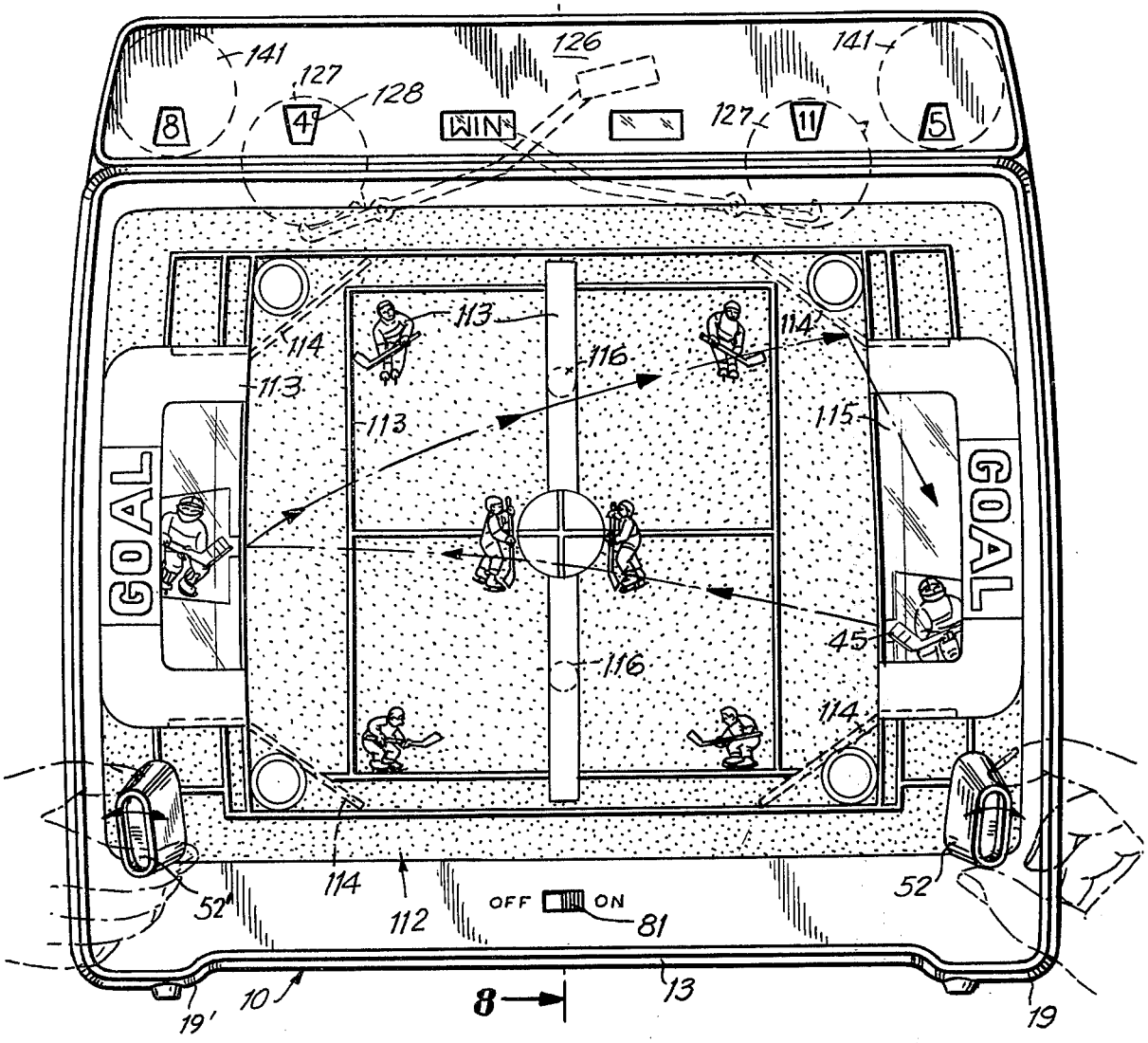
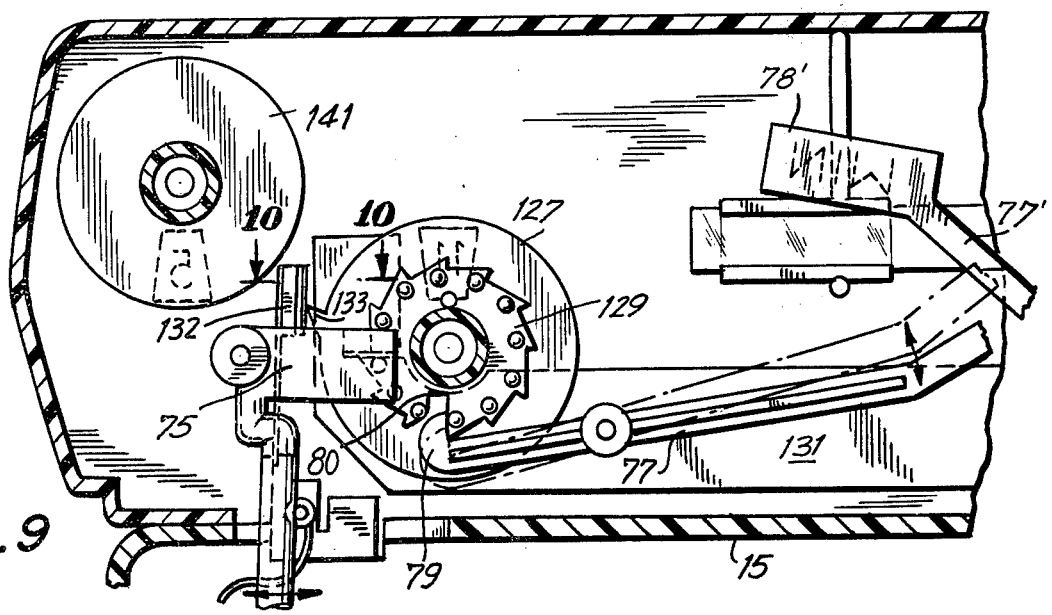
FIG. 9

DEVICE SIMULATING PLAY ACTION GAME

CROSS REFERENCE TO RELATED APPLICATION

This application is continuation-in-part of our copending application Ser. No. 544,545 for Simulated Tennis Game, filed Jan. 27, 1975, abandoned.

BACKGROUND OF THE INVENTION

The instant invention relates to a novel recreational game, and more particularly, to a device which simulates a play action such as tennis or hockey match play.

With increasing costs of games, toys and the like, it is desirable to provide a single device which may be easily adapted for a plurality of games. The device according to this invention may be adopted to a plurality of uses and games by replacing one relatively inexpensive part thereof, with other similarly constructed members which change the nature of the game being played. The adaptable nature of the device helps to sustain continued interest in it.

SUMMARY OF THE INVENTION

Generally speaking, in accordance with the invention, a device simulating a play action game is provided. The device includes a housing having an open entrance way which is overfitted by a removable screen. The screen is provided with indicia that simulate a field of play. For instance, the indicia on the screen may simulate a tennis court and be provided with base lines, in-bounds and out-of-bounds markers. Another screen embodiment may, for instance, simulate a hockey field.

Within the housing, a boom having opposed ends is mounted. One end thereof is mounted in a universal joint medianly in the housing. The other end thereof is universally movable within the housing in a plane substantially parallel to the screen.

Actuable signal means, for instance a light bulb, is mounted in the universally movable end of the boom for projecting a signal on the screen simulating a game piece in play on the simulated field. An actuable means is mounted in the housing for reciprocating the signal end of the boom across the screen.

A pair of mirror image deflectors are movably mounted in the housing for buffeting the signal end of the boom across the screen at random verticals to the reciprocal horizontal. Each deflector is independently movable along a corresponding end line of the field of play provided on the screen for thereby rallying the game piece cross court in the manner corresponding to the game simulated, as observed on the screen.

Each cross court buffet of the signal end of the boom by a respective deflector corresponds to a successful return of the game piece to an opponents zone of play, and each concomitant misregistration of a deflector and the signal end of the boom corresponds to a score for the opponent.

Means for detecting a misregistration of a deflector and the signal end of the boom are mounted in the housing. Also mounted on the housing is a scorekeeper which is operatively connected to the detector means. The scorekeeper includes registration means for recording each misregister of a respective deflector and the signal end of the boom. In one embodiment of the device the game remains in continuous play, although a pre-selected point score total has been reached. In another embodiment of the game, the game automatically concludes when one of the players has reached a predetermined point score total.

Accordingly, it is an object of the instant invention to provide a novel recreational toy capable of simulating a plurality of play action games.

Another object of the invention is to provide a toy having sustained amusement value.

A further object of the invention is to provide a recreational toy which may be used to tutor the rules of play action games.

Yet another object of the invention is to provide a recreational tool for improving its users' coordinative and manipulative skills.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 5 is an enlarged partial section taken along line 5—5 of FIG. 3;

FIG. 6 is a sectional view of the game taken along line 6—6 of FIG. 2;

FIG. 7 is an elevational front view of another embodiment of the game;

FIG. 9 is a sectional view of the scorekeeper for this embodiment, the view being taken along line 9—9 of FIG. 8;

DESCRIPTION OF THE PREFERRED EMBODIMENTS

Figure 1:
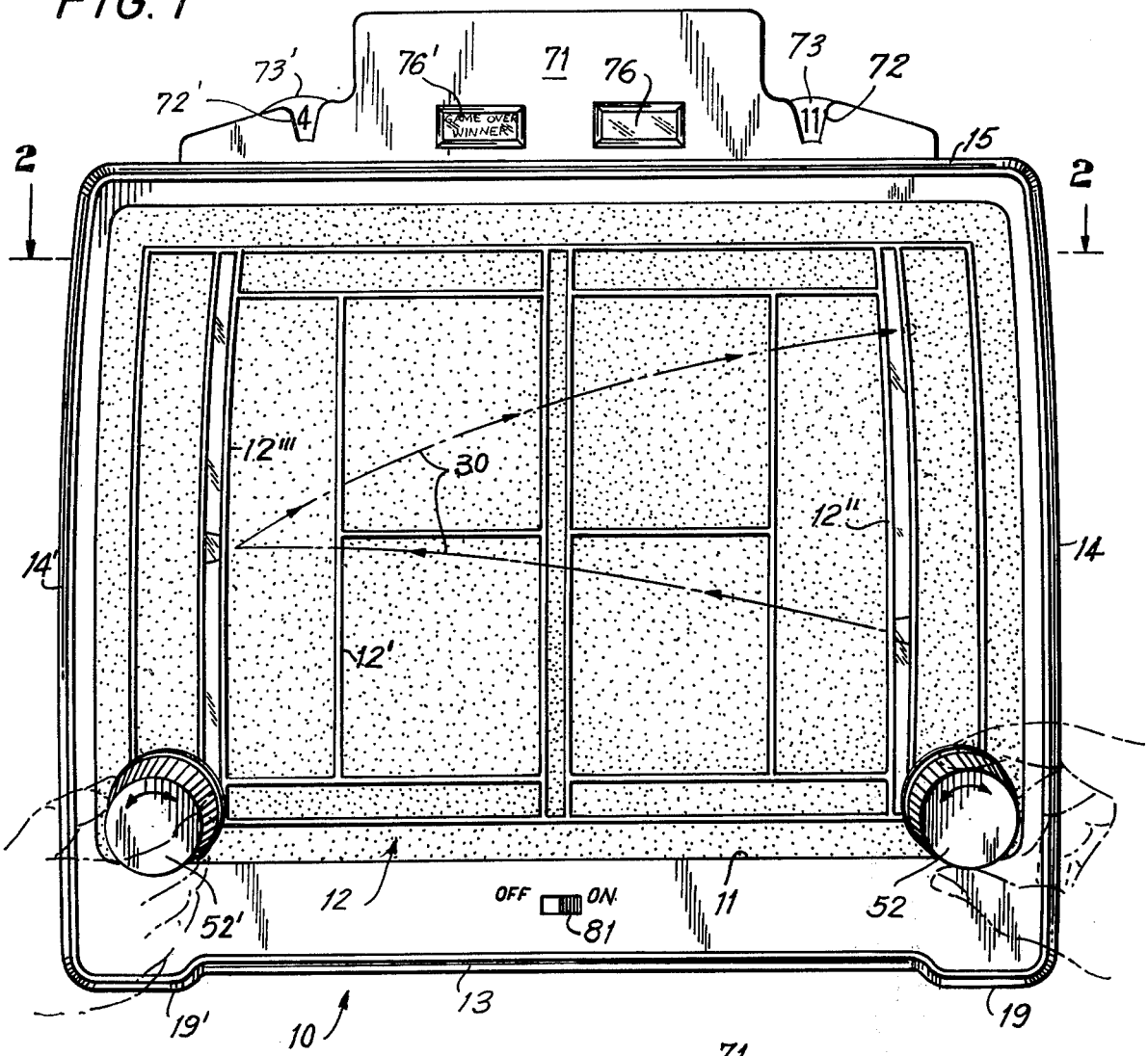
FIG. 1 is an elevational front view of one embodiment of the game.

Referring now particularly to FIG. 1-6 the game is mounted in a housing 10 having an open entranceway 11. A removable screen 12 overfits entranceway 11, thereby providing an enclosure for the game. Particularly, housing 10 includes a base 13, a pair of opposed inwardly tapered side walls 14, 14' upstanding on base 13, a top wall 15 connecting opposed side walls 14, 14', and an end wall 16. In base 13, a cam slot 17 is provided. Depending from front panel 18 are a pair of feet 19, 19' for supporting and elevating the front end of housing 10. Where base 13 joins end wall 16, a corresponding pair of shoulders, 20, 20' are formed for concomitantly supporting the rear end of housing 10.

Screen 12 is parabolic and thereby has respective convex and concave surfaces. The concave surface thereof faces inwardly towards end wall 16 of housing 10. As may be seen, with particular reference to FIG. 1, screen 12 is provided with indicia 12′ simulating a tennis court. However, reference may be made to FIG. 7 where the screen 112 is provided with indicia 112′ simulating a hockey field. For instance, base lines 12″ and 12‴ are provided on screen 12, as well as out-of-bounds markers and incourt service boxes.

Interiorly mounted at the back end of housing 10 is a boom 21. Proximate end 22 thereof, boom 21 is universally mounted in a yoke and lug assembly. A lug 23 mounted medianly rearwardly on base 13 is provided with an upwardly opening socket 24. Rotatably mounted in socket 24 is a yoke 25 including upstanding webs 26, 26′. Boom 21 is vertically pivotable on a journal pin 27 mounted in webs 26, 26′.

End 28 of the boom is universally movably mounted within housing 10 in a plane substantially parallel to screen 12. Mounted in end 28 of boom 21 is an actuable signal means 29 for projecting a signal, schematically indicated by directional arrows 30 as best seen in FIG. 1, on the screen 12 which simulates, for instance, a tennis ball in play on the simulated court. Signal means 29 may be a light bulb removably mounted in end 28 of the boom 21 which projects a concentrated beam on the concave screen surface corresponding to the simulated tennis ball. The light bulb may be battery-operated and operatively connected to a twoway switch, as hereinafter described.

Signal end 28 of boom 21 is reciprocable across screen 12 by a means 31. Particularly, means 31 includes a cam 32 rotatably mounted in cam slot 17 provided in base 13 of housing 10. Operatively connecting cam 32 and yoke 25 of the boom mounting is a means 33 for translating cam rotation into reciprocal movement comprising a bell crank drive. A lug 24 is pivotably connected at one end to a crank arm 35 and is provided with a lateral flange 36 which is releasably connected in an elbow 37 provided in cam 32. The side wall of flange 36 abuts a corresponding side wall of cam 32 in which elbow 37 is defined for thereby providing a mated mounting between flange 36 and cam 32. Upstanding on end 38 of crank arm 35 is a neck 39, and an end 40 of leaf spring 41 is connected thereto. The other end 42 of leaf spring 41 is connected to yoke 25 of the boom mounting. As cam 32 rotates, crank arm 35 oscillates leaf spring 41 for thereby reciprocating yoke 25 whereby the signal end of boom 21 is concomitantly reciprocated across the screen.

To determine the reciprocal height of the signal end of boom 21 within the field of play provided on screen 12, a forward-weight 43 is mounted in boom 21 and a counterweight 44 is mounted on end 22 thereof. The balance achieved thereby normally reciprocates the signal end of boom 21 between the transverse side walls of entrance way 11.

A pair of mirror image deflectors 45, 45′ are respectively movably mounted on side walls 14, 14′ of housing 10 for buffeting the signal end of the boom across screen 12 at random verticals to the reciprocal horizontal. Boom 21 is freely vertically pivotable on journal pin 27. Each deflector 45, 45′ includes a corresponding nose 46, 46′ which is movable therewith for abutting the signal end of boom 21 and thereby buffeting boom 21 across the field of play at a random vertical to the reciprocal horizontal.

Means 47, 47′ are provided for independently moving deflectors 45, 45′ along respective corresponding end lines 12″ and 12‴ which are base lines in the simulated tennis court provided on screen 12 for thereby rallying the simulated ball cross court in the manner corresponding to tennis match play, as may be observed on the screen. Each cross court buffet of the signal end of boom 21 by respective deflectors 45, 45′ corresponds to a successful ball return, and concomitant misregistration of a deflector 45, 45′ and the signal end of boom 21 corresponds to a missed ball which concludes a match play point. Means 47, 47′ include supports 48, 48′ respectively mounted on corresponding side walls 14, 14′ of housing 10 in respective planes substantially normal to corresponding base lines 12″, 12‴ of the simulated tennis court. A spur gear 49, 49′ is respectively rotatably mounted in supports 48, 48′.

Journalled through supports 48, 48′ is a respective rod 50, 50′ which is axially connected to a corresponding spur gear 49, 49′. Respective free ends 51, 51′ of rods 50, 50′ extend beyond overfitted screen 12 through respective slots (not shown) provided therein. Knobs 52, 52′ are respectively removably mounted on free ends 51, 51′.

Legs 53, 53′ are pivotably connected at respective ends thereof to a corresponding support 48, 48′, and deflectors 45, 45′ are connected to the respective other ends thereof. Racks 54, 54′ depend from respective legs 53, 53′ and mesh with respective spur gears 49, 49′ mounted in each corresponding support 48, 48′. Rods 50, 50′ are rotatable in first and second directions for rotating corresponding spur gears 49, 49′ for concomitantly raising and lowering respective racks 54, 54′ for thereby raising and lowering legs 53, 53′ and deflectors 45, 45′ respectively connected thereto.

Figure 2:
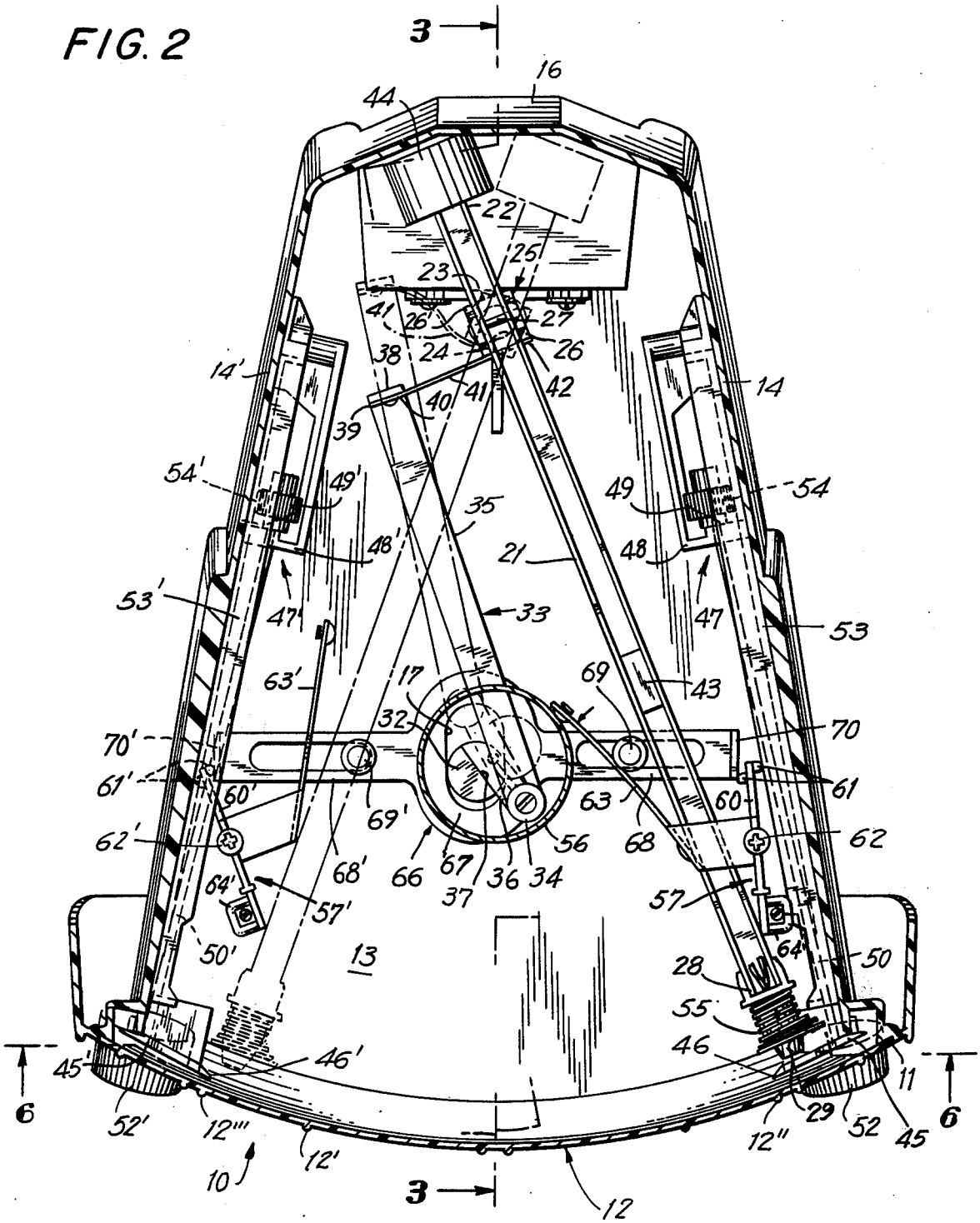
FIG. 2 is a sectional view of the game taken along line 2—2 of FIG. 1.
Figure 3:
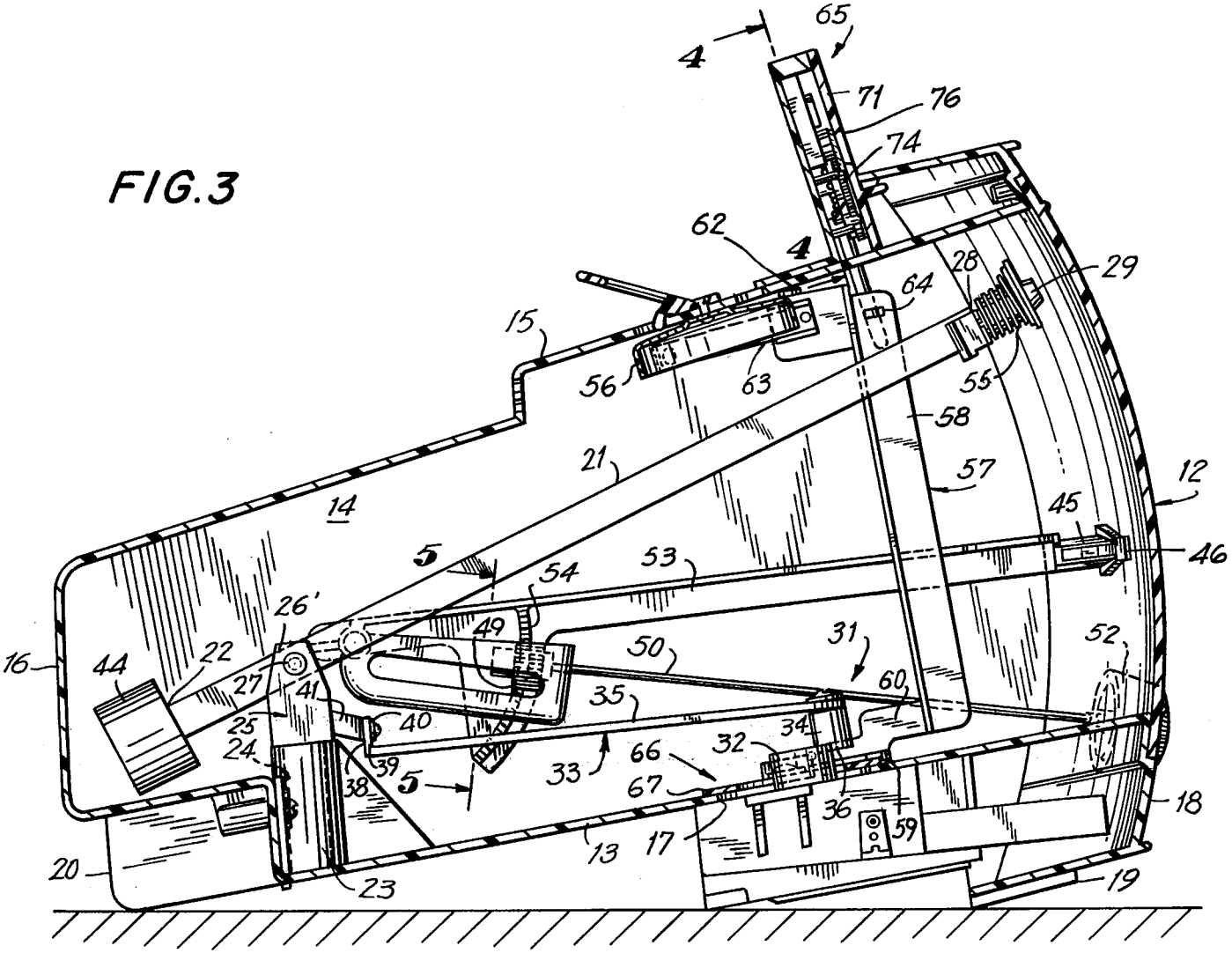
FIG. 3 is a sectional view of the game taken along line 3—3 of FIG. 2.

Surrounding signal end 28 of the boom is a pressure sensitive bias 55 which dampens an impact of signal end 28 of the boom against deflectors 45, 45′ and promotes an angular cross court movement of signal end 28 of the boom relative to the screen. As best seen in FIGS. 2 and 3, bias 55 may be a helical spring wound tightly about a portion of signal end 28 of boom 21 having outwardly flared coils surrounding the outer extremity thereof, without abutment. It is the flared portion of helical winding 55 that impacts against deflectors 45, 45′, which are substantially rigid bodies. Since the flared coils have a substantially conical profile, the abutment surface thereof is thereby maximized.

An audible signal means 56, for instance a bell housing, medianly mounted on top wall 15 is within housing 10 for signalling a misregistration of deflector 45 or 45′ and signal end 28 of the boom. A pair of detectors 57, 57′ are pivotably mounted in housing 10 for detecting a misregistration of a deflector 45 or 45′ and signal end 28 of the boom. Detectors 57, 57′ are pivotably mounted on base 13 and upstand thereon. As best seen in FIG. 6, detectors 57, 57′ are respectively pivotable between first and second positions. The first position is best seen with reference to detector 57′ in FIG. 6; and the second position is best seen with reference to detector 57 therein. The respective first positions of detectors 57, 57′ is correspondingly aligned with respective base lines 12″, 12‴ of the simulated tennis court provided on screen 12.

Each detector 57, 57′ includes a baffle 58, 58′ journalled into base 13 at respective ends 59, 59′ and journalled into top wall 15 at respective opposed ends 62, 62'. A pair of laterally extending flanges 60, 60' having opposed offset pairs of nubs 61, 61 and 61', 61' are provided on respective baffles. Means 63, 63', comprising for instance, a pair of leaf springs, are mounted for abutting bell housing 56 so as to generate an audible signal therefrom, as a baffle 58 or 58' is pivoted from its first to second position by reciprocating boom 21. A lug 64,64' is provided on baffles 58, 58' proximate respective ends 62, 62' thereof for thereby operatively connecting each detector with scorekeeper 65.

A cam follower 66 is mounted on cam 32 for translating rotation thereof into linear reciprocal movement. Cam follower 66 includes a slotted yoke 67 and a pair of aligned slotted connectors 68, 68' extending therefrom for alternately pivoting detectors 57, 57' from their respective second positions to their first positions, after one or the other thereof has been pivoted from its first to second positions by the reciprocating boom. A guide pin 69, 69' is respectively mounted in each connector slot for thereby guiding the linear reciprocal movement of cam follower 66.

As best seen in FIGS. 2 and 6, detector 57' is in its first position with a nub 61' abutting side wall 14' of housing 10 and cam follower 66 is linearly shifted to an outermost position whereby an upturned lip 70' of slotted connector 68' abuts the offset nub 61'. Simultaneously, detector 57 is shown in its second position wherein an upturned lip 70 of slotted connector 68 abuts a nub 61 thereof. Relative to detector 57, cam follower 66 is linearly shifted to its innermost position. As cam follower 66 is shifted to an outermost position relative thereto, baffle 58 is pivoted until the other nub 61 abuts side wall 14 of housing 10. In the second position of detector 57, leaf spring 63 thereof abuts into bell housing 56 thereby providing an audible signal for thereby signaling that boom 21 has abutted and pivoted detector 57 before deflector 45 was suitably manipulated to a position for buffeting signal end 28 thereof.

Figure 4:
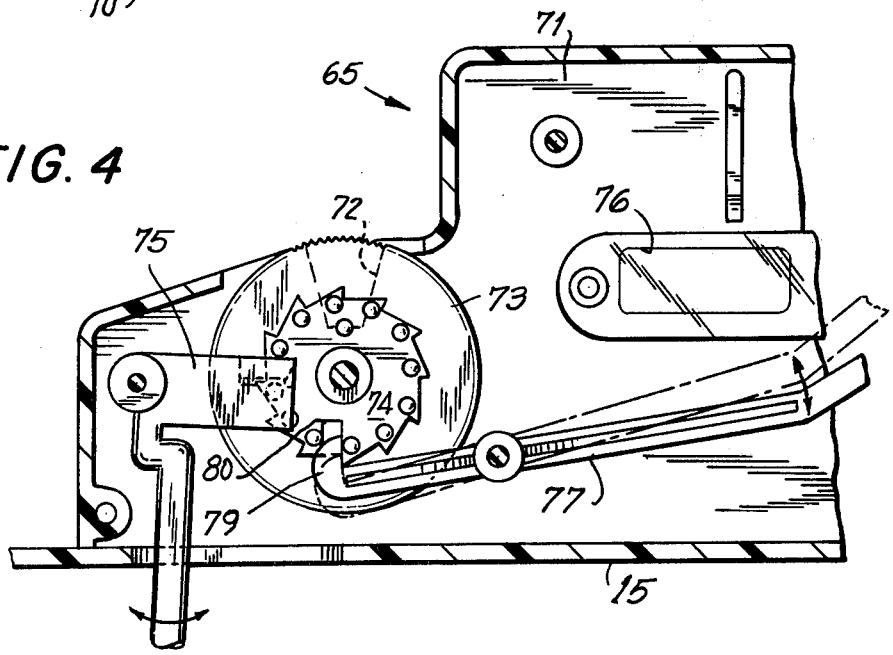
FIG. 4 is an enlarged partial section taken along line 4—4 of FIG. 3.

As best seen in FIGS. 4 and 6, scorekeeper 65 is mounted on top wall 15 of housing 10 and includes a front panel 71 having slots 72, 72' therein. A number wheel 73, 73' is rotatably journalled behind respective slots 72, 72' of front panel 71 so as to permit each slot 72, 72' to frame a number on respective wheels 73, 73'. A ratchet wheel 74, 74' is fixedly connected to each number wheel 73, 73' and a reciprocal pawl 75, 75' cooperates therewith for advancing a respective ratchet wheel for thereby concomitantly advancing a respective number wheel 73, 73' to thereby frame an advanced number in a slot 72, 72'. Pawls 75, 75' are respectively operatively connected to lugs 64, 64' of corresponding detectors 57, 57' and each pawl is reciprocally driven into engagement with a respective ratchet 74, 74' for advancing one or the others of ratchets 74, 74' as its corresponding detector is pivoted from the first to second position thereof.

A pair of game slots 76, 76' are provided in front panel 71 wherein winner's flags may be displayed according to the number sequence advanced on number wheels 73, 73'. A pair of levers 77, 77' are pivotably mounted behind panel 71 and carry gaming flags 78, 78' at an end thereof. On their respective other ends 79, 79', levers 77, 77' are provided with pawls which cam along respective ratchets 74, 74' as they are advanced. At the game point position of each number 73, 73', a slot 80, 80' is provided in respective ratchets 74, 74' and a corresponding pawl 79, 79' is received therein, thereby pivoting its associated lever 77, 77' for dropping its corresponding winner's flag 78, 78' into a game slot 76, 76'. As seen in FIGS. 1 and 6, the game point position corresponds to eleven misses or eleven failures to buffet signal end 28 of the boom before it abuts the detector. Each detected miss is counted by the pawl and the ratchet arrangement in the scorekeeper. At the eleventh miss, the winner's flag is dropped into gaming slot 76' to signify the winner and conclude the game.

Cam 32 and signal means 29 may be synchronously powered, for instance by batteries. A two-way switch 81 may be operatively connected thereto for breaking and actuating the power circuit. Means for driving cam 32 may comprise, for instance, a worm and gearing arrangement driven by a motor (not shown). For example, a cam gear may be fixedly mounted under cam 32, while a power-driven worm drives a pinion which meshes with the cam gear.

FIGS. 7 through 11 disclose another embodiment of the instant invention wherein the screen has been modified for simulation of ice hockey play. The embodiment also includes an improved scoring arrangement which provides for automatic shut-off of the game when one player has attained sufficient points to be considered the "winner".

Screen 112 is provided with indicia to simulate an ice hockey rink, including a goal, players, blue lines, etc. Mounted to the rear of the screen for extension into the path of travel of spring 55 are deflectors 114 to deflectably guide the boom toward the goal during random traversal of the screen by the end of the boom. It will be understood that in tennis a player must return balls along the entire length of the base line, while in ice hockey, for example, the goal has an opening which takes up only part of the width of the playing surface.

Figure 8:
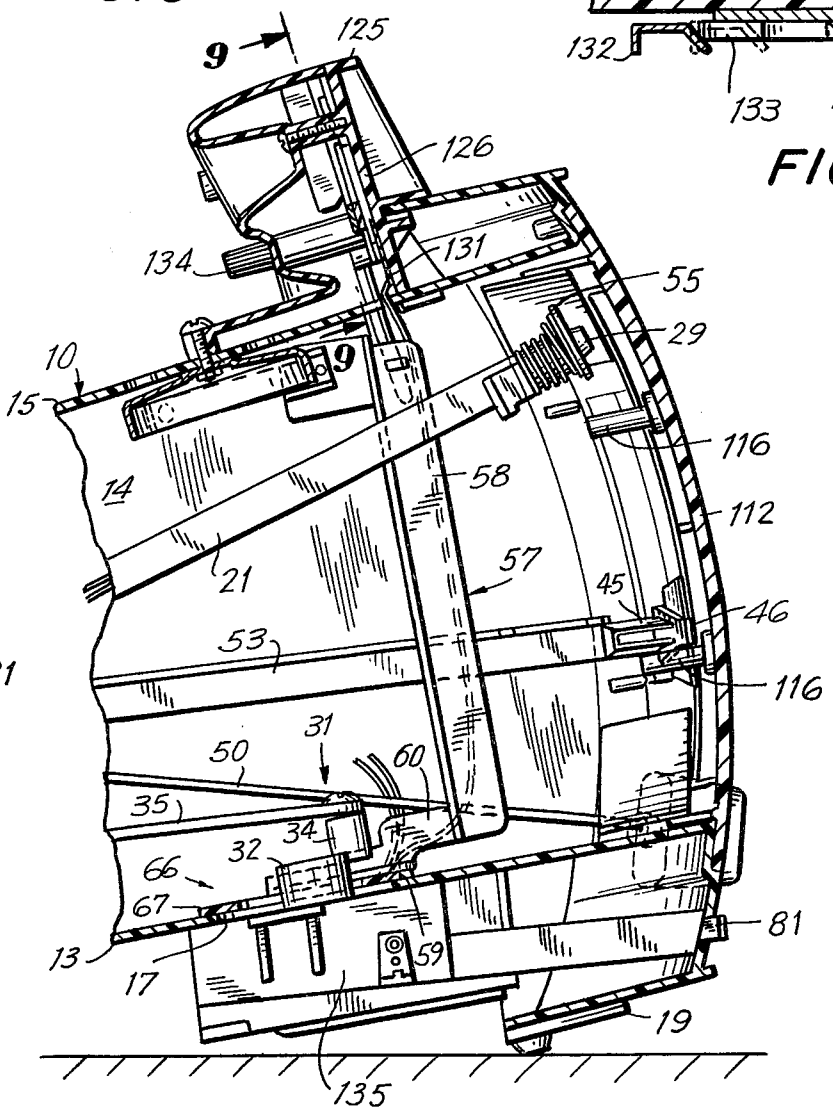
FIG. 8 is a partial sectional view of the game taken along line 8—8 of FIG. 7.

In the embodiment more particularly shown in FIGS. 7 and 8, deflectors 45 are manipulated as for the prior embodiment in order to intercept the end of boom 21 and cause it to be deflected towards the opponent's goal. If desired, a portion 115 of screen 112 within each goal may be transparent so as to be able to view not only deflector 45 but an area sufficient to view a picture of a goalie mounted thereon in order to improve the play value. In other words, the player attempts to manipulate his goalie across the face of the goal to prevent a goal being scored by misregistration.

In order to increase play value, it is also desirable that the inside surface of screen 112 be provided with bumpers 116 which also extend sufficiently so as to be in the path of movement of the end of the boom. The bumpers may be positioned at any desired location and could also have indicia representing hockey players mounted thereover. If the boom is deflected so that its path of travel is intercepted by a bumper 116, the boom may be immediately deflected back toward the goal of the player who last caused it to be struck. The possibility of immediate return before the end of the boom has traveled the entire length of the screen requires faster action on the part of the player. While only two bumbers 116 positioned across the red line have been shown, any number of bumpers at any desired location may be provided.

From this embodiment, it is evident that different types of screens for different types of games may be provided. Soccer, polo, field hockey are examples of some.

The first disclosed embodiment included scoring wheels for each player and a "winner" flag, adapted to drop into position when a player has scored a predetermined number of points or goals. However, the scoring device as more particularly shown in FIG. 4 permitted continuous play allowing the game to recommence. With the embodiment disclosed in FIGS. 9 and 10 utilizing the circuit of FIG. 11, the game will automatically shut off when the predetermined number of points has been attained by one player.

Figure 10:
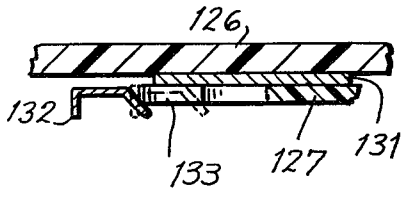
FIG. 10 is a fragmentary detail view of the disconnect means for concluding the game at a pre-selected score.

Referring to FIGS. 8–10, the scoring housing 125 is carried by the main housing 10 and includes a front wall 126. A disc 127 is rotatably mounted on front wall 126 and has indicia marked thereon for viewing through an aperture 128. A ratchet wheel 129 is provided for rotating disc 127 by means of pawl 75. The manner of rotating disc 127 in the embodiment of FIG. 9 is identical to the manner of rotating the scoring assembly shown in FIG. 4 and the disc 127 is indexed each time a misregistration occurs and results in a goal or point being scored.

The apparatus may also include a "win" flag mechanism as described in connection with the first embodiment.

Positioned adjacent front wall 126 is a contact plate 131 which forms part of the electric circuit. A switch contact 132 is deflectably mounted on scoring housing 125 and is normally biased into engagement with contact plate 131. Disc 127 is provided with a cam 133 adapted to engage and deflect switch contact 132 to separate the switch contact from contact plate 131 when disc 127 attains the "game over" condition.

Disc 127 has extending therefrom outwardly of scoring housing 125 a reset knob 134 for manually returning the disc to the "zero" position for start of a game.

The counter mechanisms, switch contacts, cams, etc., are duplicated so that a scoring mechanism is provided for each player. Contact plate 131 extends between the two counting mechisms as will be apparent by reference to FIG. 11.

Figure 11:
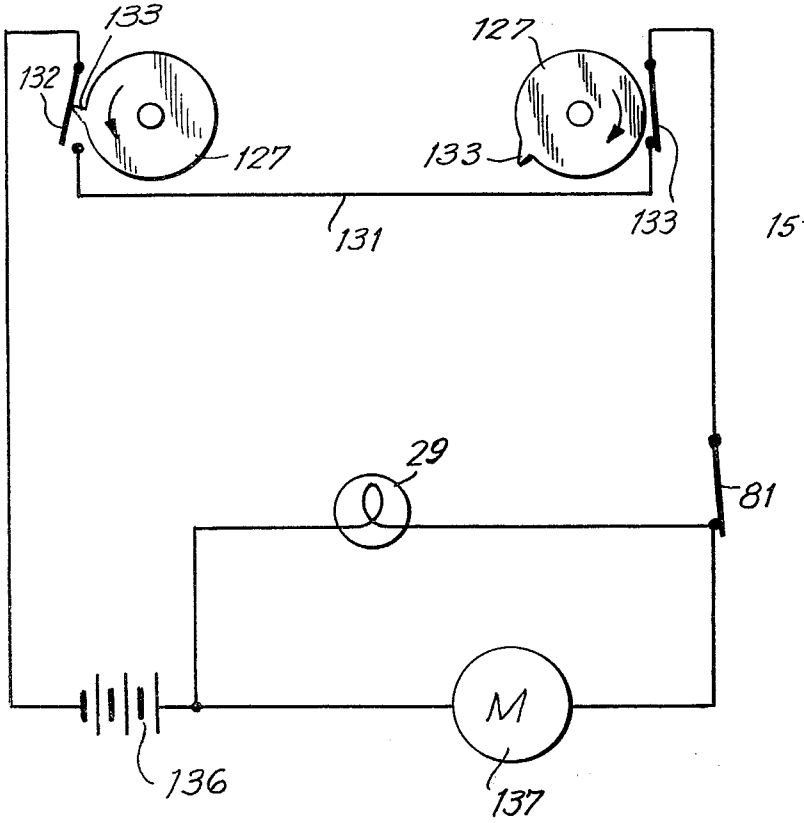
FIG. 11 is a schematic circuit diagram showing the disconnect circuit.

Referring now to FIG. 11, a power source 136 may be in the form of dry-cell batteries (mounted in battery housing 135, FIG. 8) or any other electrical power source. The motive force for driving cam 32 is an electric motor shown schematically at 137 in FIG. 11. The light 29 positioned on the end of the boom is also powered by power source 136.

To commence game play, both players reset their dials 127 to "zero" by manipulation of reset knobs 134. The game is then switched on by closing switch 81 to thereby close the circuit shown in FIG. 11. With the dials in the "zero" position, both cams 133 will be in such a condition as to permit engagement between each switch contact 132 and contact plate 131. A circuit will thereby be made to commence operation of motor 137 and illuminate light 29 and boom 21 will thereupon commence its traversal back and forth and project its light on the face of the screen to simulate the gamepiece. Upon each misregistration between the end of the boom and deflector 45, an associated disc 127 will be caused to be indexed one number as heretofore described. When one player has made sufficient scores to reach the predetermined number for a game "win", disc 127 will have attained the position shown in FIG. 4 and represented schematically in the upper left hand corner of FIG. 11 whereby cam 133 deflects switch contact 132 to move it out of engagement with contact plate 131 to thereby open the circuit, shut off motor 137 and extinguish light 129. Thus, once a player has reached a "win" position, the game automatically shuts off.

To recommence play, the players should first turn off switch 81 and thereafter reset discs 127 to "zero" position.

The scoring device may also be provided with "games won" discs 141 which are rotatably mounted in scoring housing 125 and are manually manipulated by the players to provide means by which each player can keep track of the number of games he or she has won.

While the game construction has been exemplified herein in connection with a tennis game and a hockey game, it may be seen that the game construction may be adapted to various other types of games, by appropriately changing indicia 12′ provided on screen 12. Therefore, it may be seen that the embodiment herein described is illustrative of the uses for the construction rather then limiting upon the construction.

It will thus be seen that the objects set forth above, among those made apparent from the preceding description are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A game device comprising a housing, a screen associated with said housing, indicia on the screen simulating a playing field, a boom having opposed ends, means mounting said boom for universal movement of an end thereof within said housing in a plane substantially parallel to the screen, actuable signal means mounted in said end of said boom for projecting a signal on said screen simulating a game piece in play on the simulated field, drive means mounted in said housing for reciprocating the signal end of said boom across said screen, a pair of movable deflectors movably mounted in said housing for buffeting the signal end of said boom across said screen at random verticals to the reciprocal horizontal, and means for independently moving each said deflector along a corresponding scoring position of the simulated playing field provided on the screen for thereby striking and returning the simulated game piece across the playing field in the manner corresponding to game play, as observed on the screen, each cross buffet of the signal end of the boom by a respective deflector corresponding to a successful game piece return, and each concomitant misregistration of a deflector and the signal end of the boom corresponding to a missed game piece which concludes a match play point.

2. A game device as claimed in claim 1 including detector means mounted in the housing for detecting a misregistration of a deflector and the signal end of the boom.

3. A game device as claimed in claim 2, including a scorekeeper mounted on said housing, said scorekeeper being operatively connected to said detector means, and including recording means for recording each misregister of a respective deflector and the signal end of the boom.

4. A game device as claimed in claim 1, wherein said screen is removably mounted on said housing and is parabolic having respective convex and concave surfaces, the concave surface thereof facing inwardly towards the end wall of said housing.

5. A game device as claimed in claim 1, wherein said means mounting said boom comprises a lug mounted rearwardly on said housing, said lug having an upwardly opening socket therein, a yoke rotatably mounted in said lug socket and including a pair of upstanding vertical webs, and a journal mounted in the webs of said yoke on which said boom is vertically pivotable.

6. A game device as claimed in claim 5, including a counterweight mounted on said boom for balancing same.

7. A game device as claimed in claim 1, including resilient bias means surrounding said signal end of said boom, said bias means dampening an impact of said signal end of the boom against a movable deflector and being responsive to a buffeting impact of a movable deflector for promoting an angular cross field movement of said signal end of said boom relative to said screen.

8. A game device as claimed in claim 7, wherein said signal means comprises a light bulb removably mounted in said end of said boom for projecting a concentrated beam on said screen corresponding to the simulated game piece, a power supply for illuminating said light bulb and operating said drive means, and switch means for controlling the operation of said power supply.

9. A game device as claimed in claim 1 wherein said drive means for reciprocating said signal end of the boom comprises a cam rotatably mounted in said housing, means operatively connecting said cam and boom mounting for translating rotation thereof into reciprocal movement, and means for selectively rotating said cam.

10. A game device as claimed in claim 9, including a pair of detectors pivotably mounted in said housing for detecting a misregistration of movable deflector and said signal end of said boom, each detector being pivotable between a respective first and second position, said first position of each movable detector being correspondingly aligned with a respective scoring position of the simulated playing field provided on the screen, each detector including a cam follower associated with said cam translating rotation of a detector from its first to second position into linear reciprocal movement, said cam follower including means for alternately pivoting each detector from its second position to its first position after it has been pivoted from the first to second positions by the boom.

11. A game device as claimed in claim 10, including a scorekeeper mounted on said housing, said scorekeeper comprising a front panel having a pair of slots therein, a pair of number wheels, each number wheel being rotatably journalled behind the front panel so as to permit the slot therein to frame a number on the wheel, a ratchet wheel fixedly connected to each number wheel and a pawl cooperatively spaced from each ratchet wheel so as to permit an engagement therewith for thereby rotating the ratchet wheel and affixed number wheel, each pawl being operatively connected to a detector in the housing and each pawl being driven into engagement with a respective ratchet wheel as its corresponding detector is pivoted from said first to second position thereof.

12. A game device as claimed in claim 11 wherein said device is electrically operated through a power supply and electric circuit and including circuit-breaking means associated with each said number wheels for breaking said circuit when a number wheel attains a preselected position corresponding to a "game over" condition.

13. A game device as claimed in claim 1 wherein said means for independently moving each movable deflector along a corresponding scoring position of the simulated playing field provided on the screen comprises a pair of supports, each being mounted in said housing in a plane substantially normal to a corresponding scoring position of the simulated playing field, a spur gear rotatably mounted in each support, a pair of rods having opposed ends, one end of each rod being journalled through a respective support and axially connected to a corresponding spur gear, the other end of each rod extending beyond said screen, a pair of legs having opposed ends, an end of each leg being respectively pivotably connected to a respective support, a movable deflector being connected to each corresponding other end thereof, and a rack depending from each leg meshing with a respective spur gear mounted in each corresponding support, each rod being rotatable in first and second directions for rotating a corresponding spur gear for concomitantly raising and lowering a respective rack for thereby respectively raising and lowering a leg and connected deflector.

14. A game device as claimed in claim 1 and including fixed deflectors associated with said screen for intercepting and guiding said signal end of said boom.

15. A game device as claimed in claim 14 wherein said fixed deflectors include goal-defining means.

16. A game device as claimed in claim 1, wherein said device comprises a tennis game.

17. A game device as claimed in claim 1 wherein said device comprises a hockey game.

18. A game device as claimed in claim 1 and including bumpers associated with said screen for intercepting and rebounding said signal end of said boom.

* * * * *